US005907140A

United States Patent [19]

Smith

[11] Patent Number: 5,907,140

[45] Date of Patent: May 25, 1999

[54] CIRCUIT BREAKER HAVING A SNAP-IN ATTACHABLE COLLAR

[75] Inventor: Wayne H. Smith, County of Wicomico, Md.

[73] Assignee: Eaton Corporation, Cleveland, Ohio

[21] Appl. No.: 08/939,690

[22] Filed: Sep. 29, 1997

[51] Int. Cl.[6] ..... H01H 9/00

[52] U.S. Cl. ..... 200/43.19; 200/43.16; 200/304

[58] Field of Search ..... 200/43.11, 43.13, 200/43.14, 43.16–19, 333, 334, 304

[56] References Cited

U.S. PATENT DOCUMENTS

| | | | |
|---|---|---|---|
| 2,141,936 | 12/1938 | Schmitt | 200/304 |
| 2,169,860 | 8/1939 | Von Hoorn | 200/43.15 X |
| 4,168,416 | 9/1979 | Josemans | 200/43.04 |
| 4,185,178 | 1/1980 | Drees | 200/333 X |
| 4,270,035 | 5/1981 | Richter, Sr. | 200/294 |
| 4,609,119 | 9/1986 | Richter, Sr. | 220/3.5 |
| 5,290,979 | 3/1994 | Grass | 200/43.19 |
| 5,486,660 | 1/1996 | Fasano | 200/43.16 |

FOREIGN PATENT DOCUMENTS

| | | | |
|---|---|---|---|
| 736067 | 6/1966 | Canada | 200/43.18 |

*Primary Examiner*—Renee S. Luebke
*Attorney, Agent, or Firm*—Larry G. Vande Zande

[57] ABSTRACT

A molded insulating collar for an insulating housing of a circuit breaker has a plurality of depending tabs which are received in grooves in the housing and provided with cooperating snap-fit structures within the housing to enable the collar to be sub-assembled to a circuit breaker. Collars are removable and replaceable in the field.

5 Claims, 4 Drawing Sheets

FIG. 1
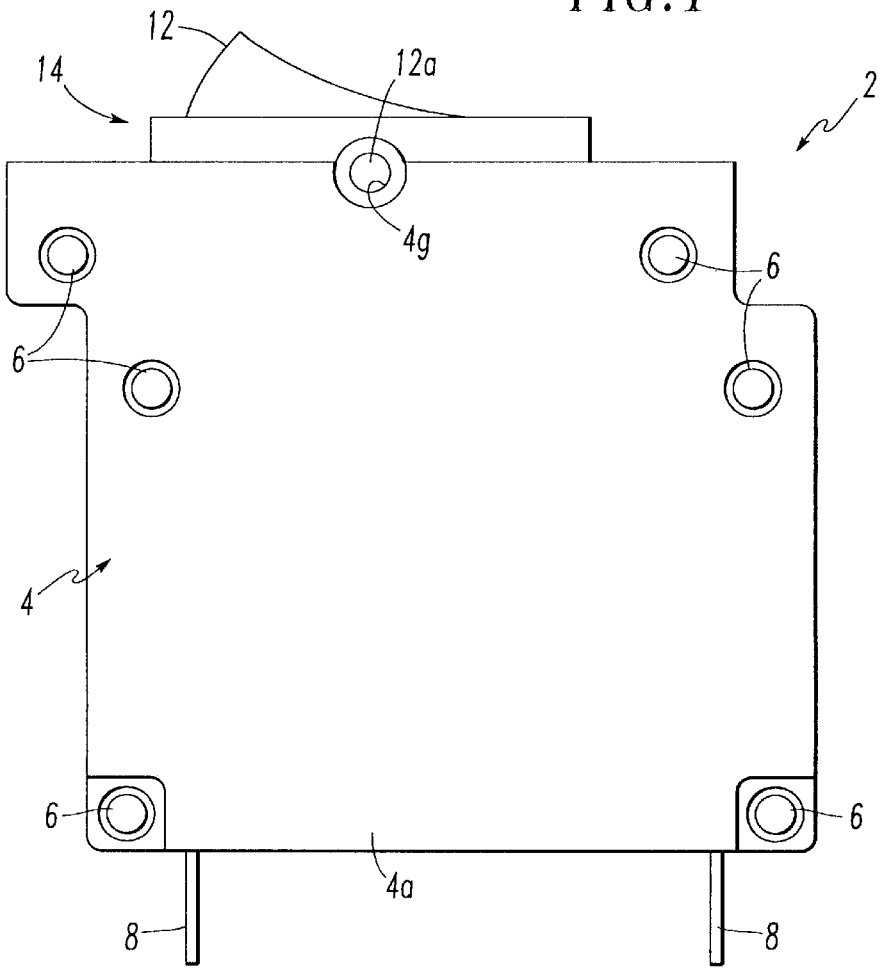
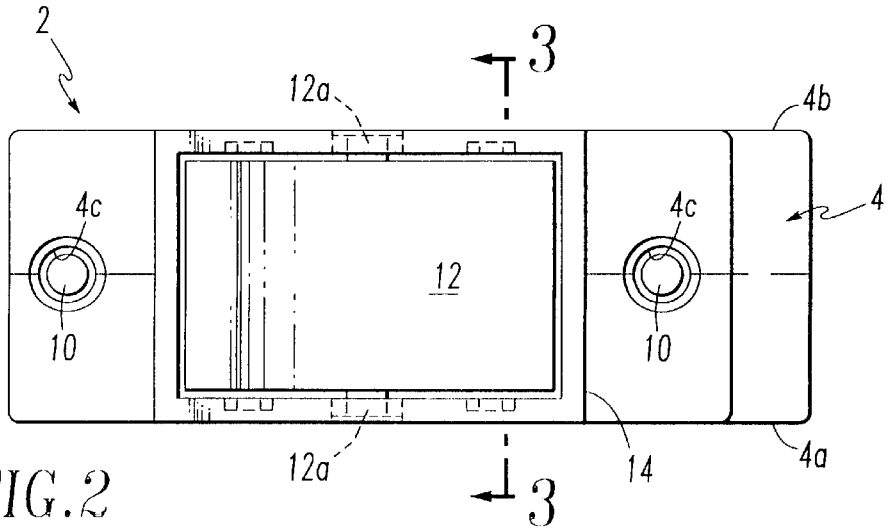
FIG. 2

CIRCUIT BREAKER HAVING A SNAP-IN ATTACHABLE COLLAR

BACKGROUND OF THE INVENTION

This invention relates to electric circuit breakers of the type having an externally accessible operator for manual operation between ON and OFF conditions More particularly, the invention relates to molded insulating housings of such circuit breakers, and still more particularly to a snap-in attachable collar for said housing which surrounds the operator and which may be selectively interchangeable with other collars having peculiar shapes to function as guards for the operator.

Circuit breakers of the aforedescribed type commonly have operators of a toggle lever or rocker type extending through a forward wall of a housing. A raised collar portion commonly surrounds the operator to project through an opening in a panel to which the circuit breaker may be mounted. Alternatively, the collar may project through a hole in a cover plate of an enclosure in which the circuit breaker is mounted.

It has been known to provide the collar with upstanding lateral walls which are coextensive with the operator to guard against unintentional contact with the operator, which contact might cause accidental operation of the circuit breaker. The lateral walls may extend forward at one or the other side of center of operator movement to function as a guard in one or the other operative positions of the circuit breaker operator, or the walls may extend forward over the full length of movement of the operator to function as a full guard in both operative positions of the operator. The particular type of collar and lateral walls of the collar are molded integrally with the housing of the circuit breaker. Accordingly, the appropriate collar or guard configuration must be determined at the time of specifying the equipment for the job. Later determinations to provide a different type of collar or guard require the complete circuit breaker to be replaced.

SUMMARY OF THE INVENTION

This invention provides a separately attachable collar for a circuit breaker having an insulating housing and an operator extending through an opening in a frontal wall of the housing. When attached the collar surrounds the opening and the operator of the circuit breaker. The collar is provided in a plurality of optional shapes with respect to the lateral or sidewalls of the collar, which may project forwardly at one or both of the ends of the collar to selectively provide a guard function for the circuit breaker operator. The collar is otherwise symmetrical end-for-end, and a single collar having sidewalls projecting forwardly at one end may be reversed end-for-end to provide a guard function for the operator in either operated position. The collar is snap-in attachable and may be subsequently removed and replaced in the field. The collar is provided with depending tabs having resilient restricted openings at the distal ends thereof which are received in open grooves in the circuit breaker housing alongside the operator, the distal ends engaging projecting bosses within the grooves.

The aforedescribed features and advantages of the invention will become readily apparent in the following description and claims when read in conjunction with the appended drawings.

BRIEF DESCRIPTION OF THE DRAWINGS

FIG. 1 is a side elevational view of a circuit breaker constructed in accordance with this invention;

FIG. 2 is a plan view of the front of the circuit breaker shown in FIG. 1;

DETAILED DESCRIPTION OF THE PREFERRED EMBODIMENTS

Figure 3:
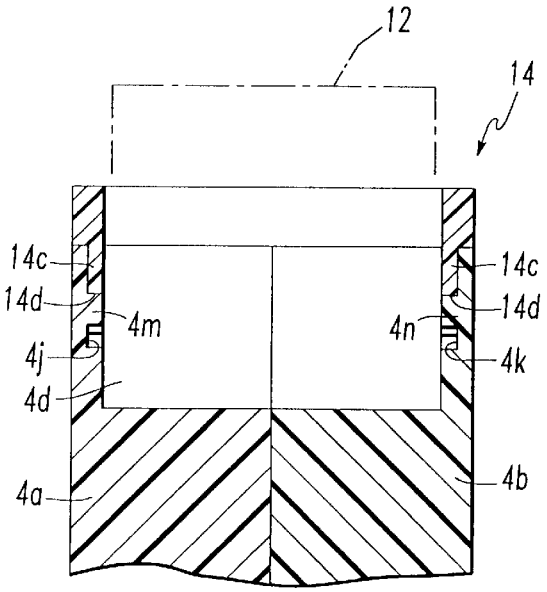
FIG. 3 is a sectional view taken along line 3—3 of FIG. 2, showing attachment of the collar to the circuit breaker housing.

An electric circuit breaker 2 as shown in the drawings comprises an insulating housing 4 which consists of a pair of mating members 4*a* and 4*b* secured together by a plurality of rivets 6. Housing members 4*a* and 4*b* are preferably molded, substantially mirror-image shells, although the parting plane could be offset to one side, providing an open case and a narrow cover if desired. Although not shown in the drawings, the shells 4*a* and 4*b* have hollow interiors which cooperate to define an internal chamber in which is mounted the mechanism of the electric circuit breaker. A pair of electrical terminals 8 project from a rear wall of the housing 4 for connection of the circuit breaker in an electric circuit. Housing shells 4*a* and 4*b* cooperate to define circular openings 4*c* (FIGS. 2 and 4) in the frontal wall which lead to internal pockets that trap threaded nuts 10 (FIG. 2) for receiving screws which are used to attach the circuit breaker 2 to a panel.

Figure 4:
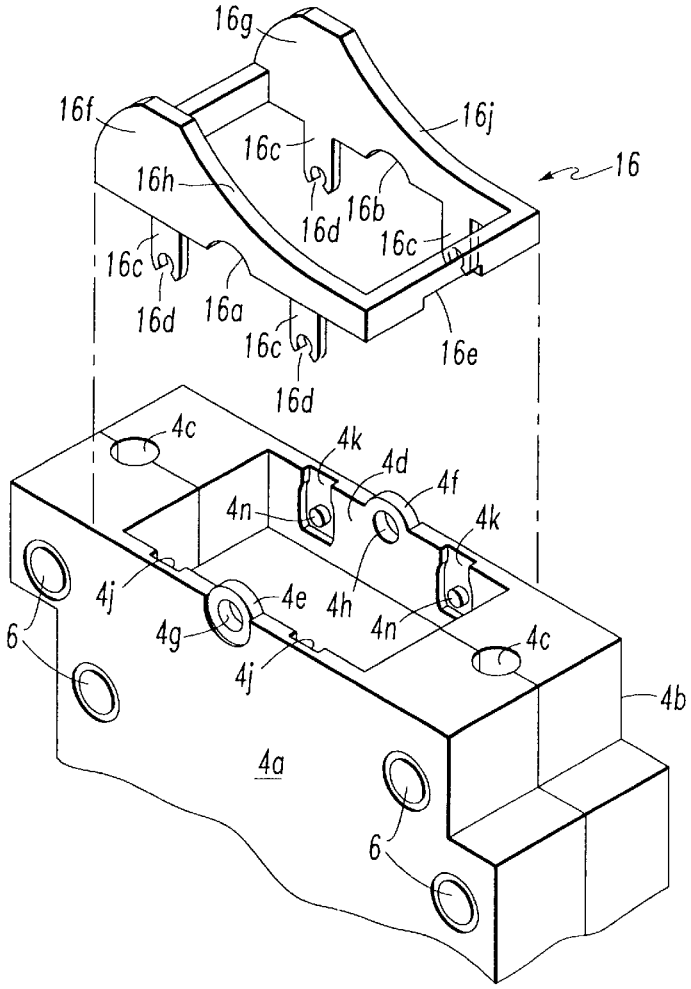
FIG. 4 is an exploded isometric view of the circuit breaker housing, with the operator removed for clarity, and one optional collar constructed in accordance with this invention.
Figure 5:
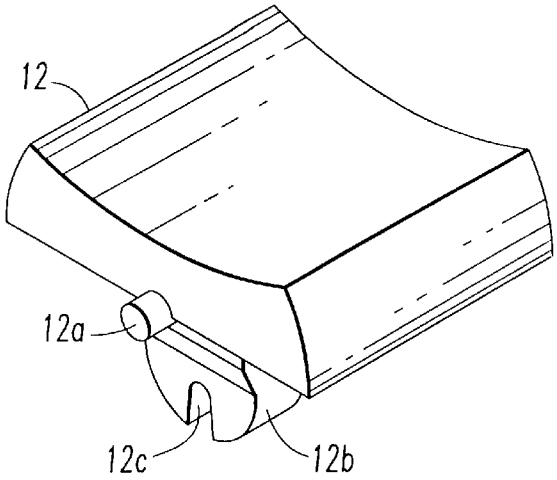
FIG. 5 is an isometric view of an operator for the circuit breaker shown in FIG. 4.

As best seen in FIG. 4, housing shells 4*a* and 4*b* also cooperate to define an opening 4*d* for the operator of the circuit breaker. The lateral walls of housing shells 4*a* and 4*b* have raised arcuate projections 4*e* and 4*f* at the front wall of the housing to provide material surrounding axially aligned holes 4*g* and 4*h* which receive the trunions such as 12*a* (FIG. 5) of a rocker type pivoted operator 12. A post 12*b* extends downwardly from operator 12 to project into the interior chamber of housing 4 for connection with the circuit breaker operating mechanism by means of a slot 12*c* in the post 12*b*. Although a rocker style operator is illustrated in this particular embodiment, it is to be understood that other types of operators can be equally well employed such as a toggle lever, a slide button or the like. Moreover, the location and particular construction details of the operator pivot may vary as other styles of operators are used.

Figure 6:
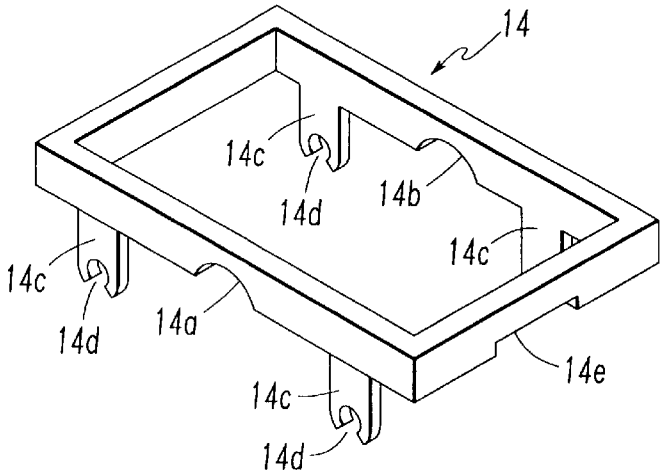
FIG. 6 is an isometric view of a basic collar constructed in accordance with this invention.

Referring particulary to FIG. 4, it can be seen that the frontal wall of the housing 4 as constructed in accordance with this invention is essentially flat, or planar, with the exception of the arcuate bosses 4*e* and 4*f* around the pivot openings 4*g* and 4*h*. It is customary for circuit breaker housings of this type to have a forwardly projecting collar surrounding the opening 4*d* and the operator 12. In accordance with this invention, a collar is provided to be subsequently attached to an assembled circuit breaker comprising the housing shells 4*a* and 4*b* assembled around the operator 12 and secured together by the rivets 6. The collar may be a plain rectangular style such as collar 14 shown in FIG. 6. Alternatively, the collar may have an operator guard function incorporated therein such as collars 16 shown in FIG. 4 or 18 shown in FIG. 7. The three collars 14, 16 and 18 are each rectangular in shape. Collar 14 has all four walls of a common height. The lateral walls are provided with arcuate recesses 14*a* and 14*b* to overlie the arcuate projections 4*e* and 4*f* of the housing shells 4*a* and 4*b*. Collar 14 has four depending tabs 14*c* arranged symmetrically from the lateral walls. The ends of each of the tabs 14*c* have a circular hole 14*d* formed therein. A portion of the end of the tab is removed to communicate with hole 14*d* to provide a constricted opening in the distal end of each tab. The remaining portion of the tabs adjacent the restricted opening function as resilient fingers for deflecting around a boss within the housing 4 as will be described in greater detail hereinafter. The end walls of collar 14 are provided with relieved tool access slots 14*e* (only one shown) in the outer lower surface to facilitate removal of the collar from housing 4 if so desired.

As seen in FIG. 4, collar 16 is essentially identical to collar 14 at the right-hand end and with regard to all of the lower features such as the tabs and relieved arcuate slots and tool access slots. For this reason, the various elements on collar 16 which correspond directly to elements on collar 14 are given corresponding alpha suffix characters. The lateral and end walls of collar 16 are similar to the corresponding walls of collar 14 at the right-hand end as viewed in FIG. 4. However, the lateral walls project substantially forward at the left-hand end of collar 16 to a second height to provide guard portions 16*f* and 16*g* at the left-hand end. The respective upper edges of the lateral walls of collar 16 are joined between the first and second heights by transition portions 16*h* and 16*j* which in the particular embodiment shown are large radiused curved sections which make a smooth transition with the right-hand end and curve up to the second height at the left-hand end. The particular shape of the guard portions 16*f* and 16*g* and the transition sections 16*h* and 16*j* can be varied according to the style of operator used with the circuit breaker.

Figure 7:
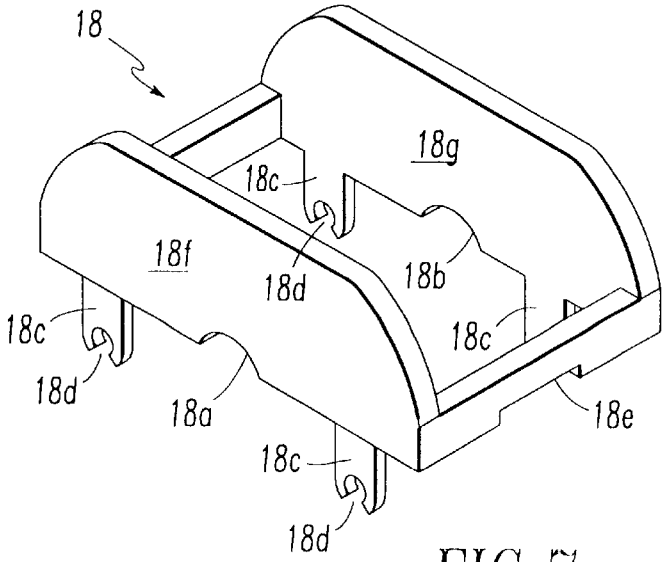
FIG. 7 is an isometric view of another optional collar constructed in accordance with this invention.
Figure 8:
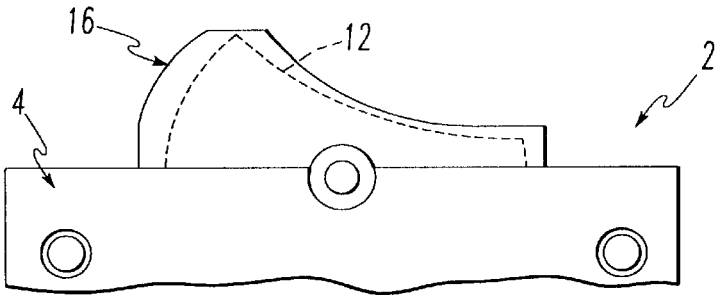
FIG. 8 is a partial side elevational view of the circuit breaker showing one of the collars positioned to guard the operator in one operational position of the operator.
Figure 9:
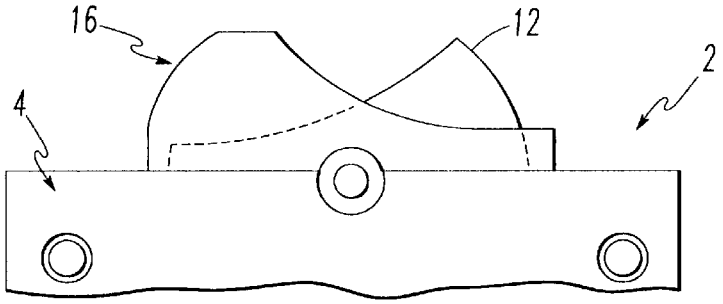
FIG. 9 is a partial side elevational view like FIG. 8 showing the operator in another operational position.
Figure 10:
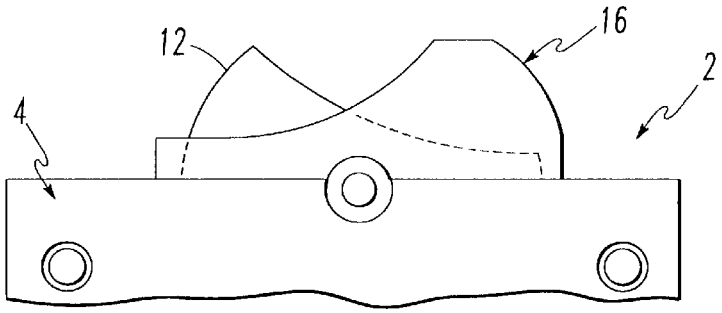
FIG. 10 is a partial side elevational view like FIG. 8, but showing the collar rotated end-for-end (180°) and attached to the housing.
Figure 11:
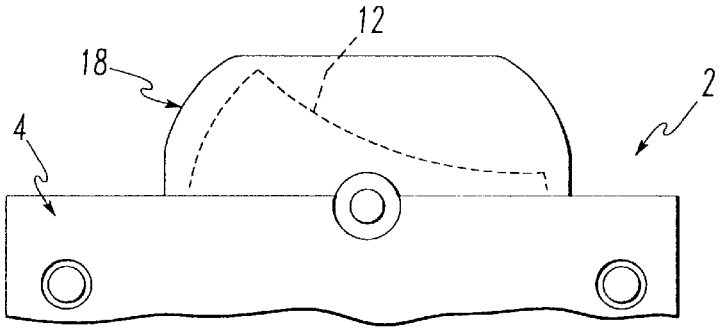
FIG. 11 is a partial side elevational view like FIG. 8, but showing another of the collars attached to the housing for guarding the operator in both operational positions of the operator.

Collar 18 shown in FIG. 7 represents a third alternative embodiment. As before, the lower features which directly correspond to identical features on collar 14 have been given corresponding alpha suffix characters (where visible). The lateral walls 18*f* and 18*g* of collar 18 extend forwardly to a height generally corresponding to the height of guard portions 16*f* and 16*g*, although the lateral walls 18*f* and 18*g* comprise the entire end-to-end length of the collar 18 to provide a guard function for the operator 12 in both operated positions thereof.

Referring again to FIG. 4, it can be seen that the lateral walls of housing shells 4*a* and 4*b* which define the operator opening 4*d* are provided with recessed grooves 4*j* and 4*k* which are open to the forward surface of the housing 4. The lower ends of the grooves 4*j* and 4*k* are widened slightly as compared to the width at the open forward ends and each groove is provided with an inwardly projecting cylindrical boss 4*m* and 4*n* (FIGS. 3 and 4). The grooves 4*j* and 4*k* are symmetrically arranged on opposite sides of the axis extending between pivot openings 4*g* and 4*h*.

A collar 14, 16 or 18 may be selected according to the desired function of the collar and installed by inserting the appropriate depending tabs into the respective grooves 4*j*, 4*k* alongside the operator 12 until the constricted openings rest against the respective bosses 4*m* and 4*n*. The collar then is pressed firmly against the forward surface of the housing 4, causing the resilient finger portions of the tabs to deflect around the bosses to secure the collar to the breaker housing with a snap-in fit. As mentioned previously, when the collar 16 is utilized, it is positioned end-for-end with respect to the particular position of the operator that is preferred to be guarded. If it is subsequently desired to replace the collar with another or to change the guarded position of the operator, the attached collar can be removed by inserting a tool in the relieved groove 16*e* at each end of the collar and using the tool to pry the collar loose from its engagement with the bosses 4*m* and 4*n*. The collar 16 may then be removed, repositioned in the opposite orientation or a different collar positioned on the breaker and pressed down into snap-in engagement with the housing.

Thus this invention provides a customer with great flexibility in providing guarded operator functions for a circuit breaker without having to stock a number of different styles of circuit breakers. A workman installing or performing maintenance or upgrade on a system in the field only need have a few inexpensive molded plastic collars in order to achieve the desired guarding functions. Although the invention has been shown in the best mode contemplated for practicing the invention, it is to be understood that the invention is susceptible to various modifications without departing from the scope of the appended claims.

I claim:

1. A circuit breaker having an insulating housing, an opening in said insulating housing, an operator projecting through said opening, said operator having sides disposed closely adjacent lateral walls of said opening, and an insulating collar attachable to said housing for surrounding said opening and said operator, said collar and said housing comprising complemental snap fastener elements for attaching said collar to said housing, said complemental snap fastener elements comprising tabs depending from said collar extending into said opening and means on said lateral walls of said opening engaged by said tabs, said means comprising slots recessed into said lateral walls of said opening and bosses in said slots, and said tabs comprise openings at said distal ends thereof for deflecting around respective said bosses when said collar is pressed against said housing during attachment of said collar to said housing, said tabs deflecting within said slots in directions parallel to said lateral walls.

2. The circuit breaker as claimed in claim 1 wherein said collar comprises side walls extending along opposite sides of said operator, said operator being pivotally movable between first and second positions about an axis extending between said opposite sides, said side walls extending to a first height at one end of said collar and to a second height at an opposite end of said collar, said side walls at said one end exposing at least a portion of said operator in said first position of said operator, and said side walls at said opposite end being substantially coextensive with said operator in said second position of said operator.

3. The circuit breaker as claimed in claim 2 wherein said collar is selectively attachable to said housing for positioning said side walls at said second height at a selected one or another end of said operator.

4. A circuit breaker comprising an insulating housing having an opening therein open to an exterior surface of said housing, an operator projecting through said opening and having sides disposed closely adjacent lateral walls of said opening, and an insulating collar attachable to said housing at said exterior surface for surrounding said opening and said operator, said collar and said housing comprising complemental snap fastener elements for attaching said collar to said housing, said complemental snap fastener elements comprising slots recessed into said lateral walls of said opening, said slots being open to said exterior surface of said housing, and tabs depending from said collar inserted into said slots from said exterior surface, wherein said complemental snap fastener elements comprise bosses in said slots and open distal ends of said tabs deflecting around said bosses upon insertion of said tabs into said slots, said tabs deflecting within said slots in directions parallel to said lateral walls.

5. The circuit braker as claimed in claim 4 wherein said collar comprises side walls extending along opposite sides of said operator, said side walls extending to a first height at one end of said collar and to a second height at an opposite end of said collar, and said collar is attachable to said housing in a selective one of two positions which are rotationally displaced one hundred eighty degrees.

* * * * *